United States Patent [19]

Nichols

[11] 3,966,161

[45] June 29, 1976

[54] DESK CALENDAR WITH EASEL

[75] Inventor: Gordon E. Nichols, Middleboro, Mass.

[73] Assignee: Winthrop-Atkins Co., Inc., Middleboro, Mass.

[22] Filed: May 19, 1975

[21] Appl. No.: 578,809

[52] U.S. Cl. ..... 248/459; 248/465; 206/45.25

[51] Int. Cl.[2] ..... A47B 97/04

[58] Field of Search ..... 248/454, 455, 456, 457, 248/459, 460, 461, 462, 463, 464, 465, 469, 472, 474, 479; 211/73; 229/17 R; 40/152.1, 152.2, 155, 120, 124.1; 206/45.24, 45.25, 45.26

[56] References Cited

UNITED STATES PATENTS

| | | | |
|---|---|---|---|
| 1,330,946 | 2/1920 | Locke | 206/45.25 |
| 1,780,760 | 11/1930 | McClelland et al. | 206/45.25 |
| 1,909,472 | 5/1933 | Keppler | 206/45.26 |
| 2,383,776 | 8/1945 | Cross | 248/459 |
| 2,716,485 | 8/1955 | Hecker | 206/45.25 |
| 2,730,232 | 1/1956 | Coe | 206/45.26 |
| 3,473,777 | 10/1969 | Ketterer | 248/459 |

*Primary Examiner*—Robert A. Hafer
*Attorney, Agent, or Firm*—Robert T. Gammons

[57] ABSTRACT

An easel type display mount having a headboard and for supporting it upright a leg hinged at its upper end to the rear side for movement to an angular rearwardly disposed position and articulated braces and locking pads connected to the leg with portions frictionally engaged within pockets to retain the leg within the opening when folded and to hold the leg distended at said angular supporting position.

12 Claims, 9 Drawing Figures

DESK CALENDAR WITH EASEL

BACKGROUND OF INVENTION

Easel type mounts are old in the art and embody blanks and braces of various designs as disclosed, for example, in the Ketterer U.S. Pat. Nos. 3,357,671 and 3,473,777 and also in the Cross U.S. Pat. No. 2,383,776; Horr, U.S. Pat. No. 2,395,122 and Taylor, U.S. Pat. No. 2,730,324. In the Ketterer patents there are provided a leg, brace and locking tab of a specific design wherein the leg is supported rearwardly by a locking tab which is slidingly engaged within the body of the mount. In Horr there is shown a leg with supporting wings at opposite sides which must be manually engaged with notches to support the leg in its rearwardly disposed position. Taylor shows another structure in which there are wings at opposite edges of the leg, however, the structure is quite different from the easel forming the subject matter of this invention. The easel type mount as disclosed herein is of improved design particularly with reference to a much simpler starting blank for making the mount and to a structure which provides for folding of its component parts entirely within the dimensions of the headboard.

SUMMARY OF INVENTION

As herein illustrated the easel comprises a headboard containing between its front and back surfaces a pocket, and in the back surface an opening into the pocket symmetrically disposed with respect to the pocket so that portions of the pocket extend laterally from opposite edges of the opening, a leg member hinged at its upper end within the opening on a hinge coinciding with the top of the opening for angular movement rearwardly from the opening and means for supporting the leg in an angular rearwardly disposed position relative to the headboard to hold the latter upright, comprising braces and tabs slidingly engaged within the pocket at each side of the opening, said braces being hingedly connected to the longitudinal edges of the leg and to the tabs so that when the leg is disposed rearwardly the hinges connecting the braces to the tabs coincide with the edge of the openings and the braces extend forwardly therefrom to the leg and when the leg is disposed in the opening the braces and tabs lie within the pocket.

The invention will now be described in greater detail with reference to the accompanying drawings, wherein.

Figure 1:
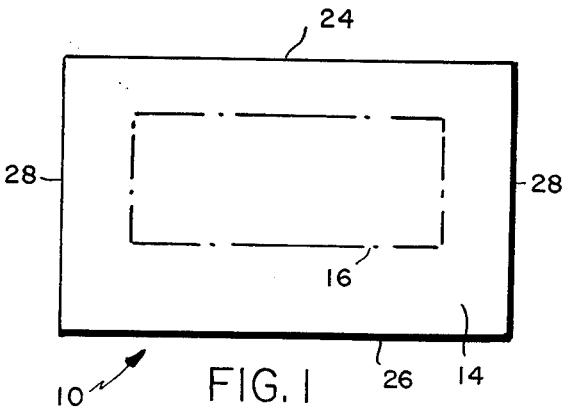
FIG. 1 is a front elevation of the easel showing in dot and dash lines a calendar pad fastened thereto.

Referring to the drawings, the easel comprises a multi-ply substantially rectangular headboard 10 supported in an upright rearwardly inclined position by a leg 12 for receiving and supporting on its sloping front surface 14 a calendar pad 16, photograph or the like and, optionally, an appropriate legend or advertising media.

Figure 2:
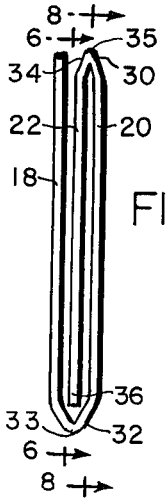
FIG. 2 is an end view to larger scale with the several plies of the easel separated to more clearly illustrate the inter-relation of the plies.
Figure 4:
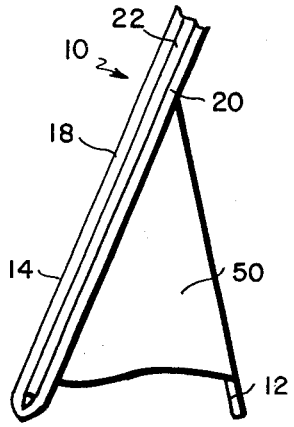
FIG. 4 is an end view of the easel with the leg extending rearwardly from the back supporting the easel in an upright position.
Figure 3:
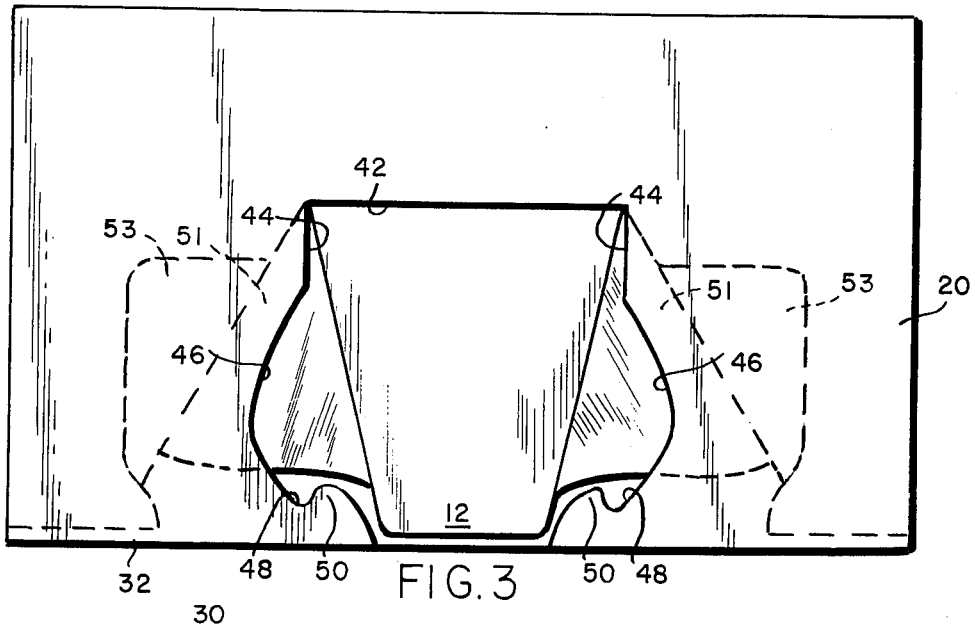
FIG. 3 is a back view of the easel to very much larger scale with the leg folded into the plane of the back side.
Figure 5:
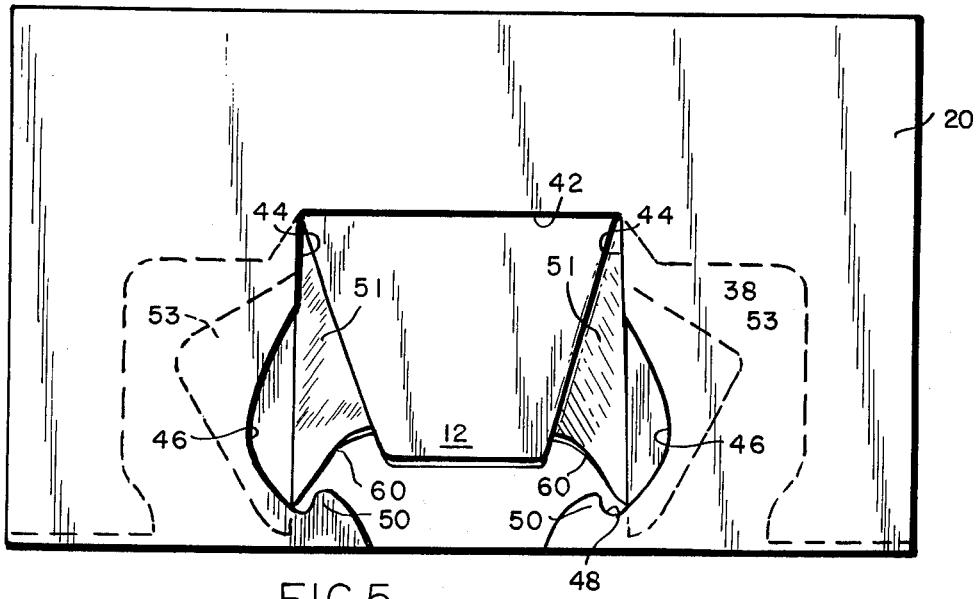
FIG. 5 is a view similar to FIG. 3 with the leg extending rearwardly from the back side as shown in FIG. 4.

The headboard 10 is comprised of a face board 18, a backboard 20 and an intermediate board 22, FIG. 2. The face board 18 is rectangular as herein shown having spaced parallel top and bottom edges 24 and 26 and spaced parallel end edges 28—28. The backboard 20 is correspondingly substantially rectangular, having spaced parallel top and bottom edges 30 and 32, the lower edge 32 being connected to the lower edge 26 of the face board by a hinge 33. The intermediate board 22 is also substantially rectangular and has spaced parallel upper and lower edges 34 and 36, the upper edge 34 being connected to the upper edge 30 of the backboard by a hinge 35. The intermediate board 22 is disposed between the face board 18 and the backboard 20 and the several plies may be connected by stapling, glueing or the application of an over-edge strip to the entire periphery of the structure comprised of the face board, backboard and intermediate board. In accordance with the invention portions of the inner surfaces of the face board and backboard are unattached to the intermediate board so as to provide a pocket 38 in the intermediate board, FIGS. 6 nd 7, between the face board and the backboard. Although the several plies are herein illustrated as being substantially coextensive it is within the scope of the invention to make the backboard and intermediate board of lesser overall area and of different configuration.

Figure 8:
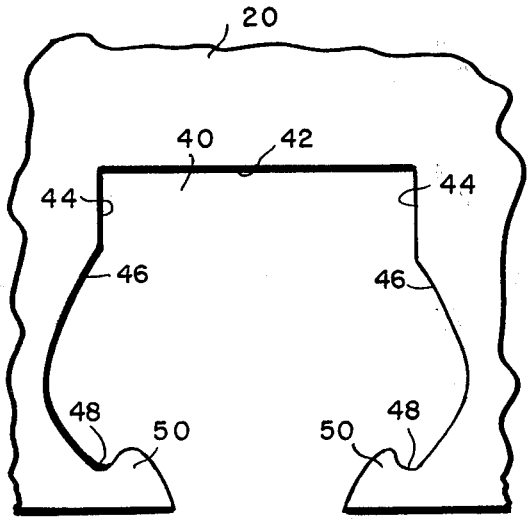
FIG. 8 is a fragmentary section taken on the line 8—8 of FIG. 2.

The backboard 20, FIG. 8, contains symmetrically with respect to its opposite ends, an opening 40 having a top edge 42 spaced from and parallel to the top edge 30 and side edges comprising spaced parallel edge portions 44—44 perpendicular to the edge 42 and reentrant edge portions 46—46 extending from the edge portion 44—44 to the lower end of the back. The reentrant edge portions 46—46 diverge at their upper ends and converging at their lower ends, the converging portions containing notches 48—48 bounded by shoulders 50—50.

Figure 6:
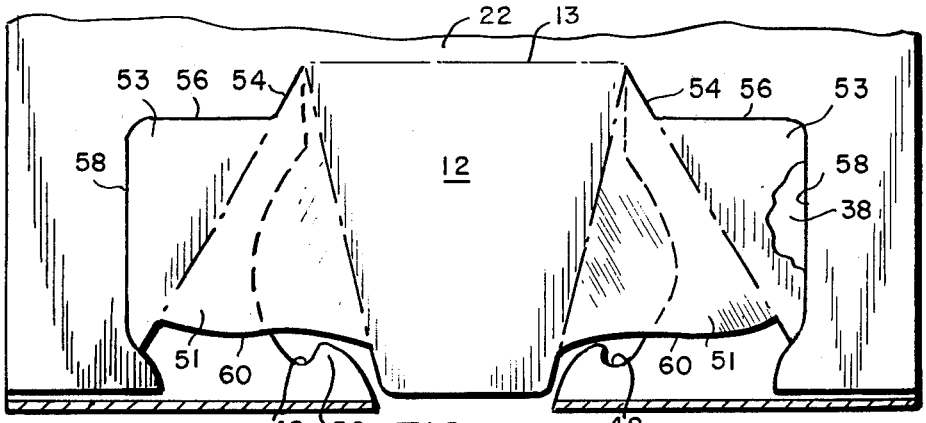
FIG. 6 is a fragmentary section taken on the line 6—6 of FIG. 2 with the leg disposed in the plane of the easel.
Figure 7:
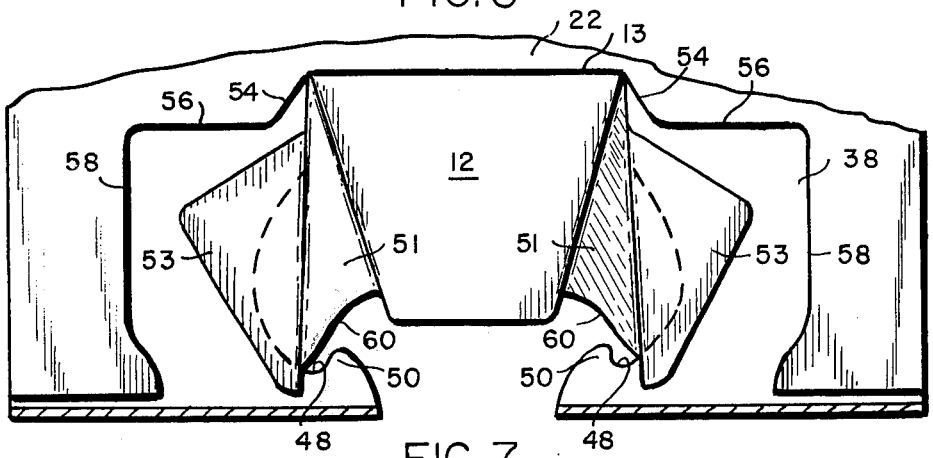
FIG. 7 is a view similar to FIG. 6 with the leg extending rearwardly from the easel.

The leg 12 is connected to the structure between the face board and backboard for angular movement about a hinge 13 coinciding with the upper edge 42 of the opening 40 and as herein illustrated is formed out of the intermediate board 22 as shown in FIGS. 6 and 7, together with braces 51—51 at the opposite longitudinal edges of the leg and anchoring tabs 53—53. The braces are substantially triangular in shape and are hingedly connected along one edge to the opposite longitudinal edges of the leg 12 and at their opposite edges to the tabs 51—51. the hinges are formed by scoring, embossing or otherwise weakening the board of which the several parts are comprised to enable folding of the braces relative to the leg and of the tabs relative to the braces. As shown in FIG. 6, the leg, braces and tabs lie in a single plane connected at 13 to the intermediate board within an opening formed in the intermediate board by spaced divergent cut lines 54—54, horizontal cut lines 56—56 extending from the lower ends of the cut lines 54—54 and spaced parallel vertical cut lines 58—58 extending downwardly from the outer ends of the cut lines 56—56. The leg, braces and tabs are connected in said opening solely by the hinge 13 at the end of the leg. As thus constructed the leg can be swung out of the plane of the intermediate board about the hinge 13 at its upper end.

The opening 40 in the backboard is transversely wide enough to permit the leg to be swung rearwardly through it but is not wide enough to permit free swinging movement of the braces rearwardly, the latter being retained at their outer edges between the face board and backboard by the tabs 53—53 which are frictionally engaged in the pocket 38 between the inner faces of the face board and the backboard so that as the leg is drawn outwardly from the back the braces fold about their outer edges where connected to the leg and at their inner edges where connected to the tabs. Rearward movement of the leg is limited by the braces and the tabs, the latter holding the rear ends of the braces abutting the inner surface of the face board substantially in alignment with the edges 44—44 of the opening 40. The re-entrant edges 46—46 provide clearance for the braces as they are withdrawn at an angle to the backboard and the latter are guided during their angular movement both away from and towards the backboard by engagement of the lower edges 60—60 of the braces within the notches 48—48. The shoulders prevent the edges 60—60 from being disengaged from the notches.

The leg can be withdrawn to set it in an angular position relative to the backboard merely by pulling outwardly thereon so as to slide the braces and tabs in the pocket. The frictional resistance to movement of the braces and tabs in the pocket providing means for retaining the leg in either of its positions, to wit, within the opening when the easel is folded for non-use and displaced at an angle rearwardly thereof when the leg is distended for use.

Figure 9:
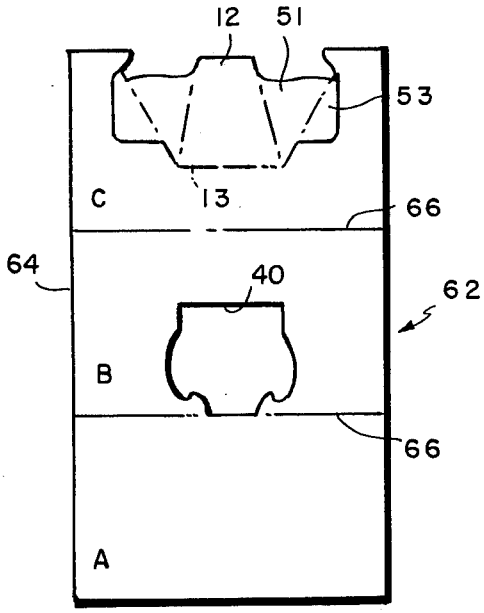
FIG. 9 is a plan view of the blank for the easel.

The structure is designed to be easily formed from a single blank 62, as shown in FIG. 9, by die cutting from sheet material, or example stiff paperboard, a substantially rectangular panel 64 divided transversely by spaced parallel lines 66 into sections A, B and C of equal area which comprise, respectively, the face board 18, backboard 20 and intermediate board 22. Simultaneously the opening 40 is formed in the backboard and the leg, braces and tabs are formed in the intermediate board. The blank is folded on the lines 66—66 to place the intermediate board between the face board and backboard whereupon the several plies are glued together marginally or fastened together by staples or by an edge strip leaving the inner surfaces of the face board and the backboard in the area of the opening defined by the cut lines 54—54, 56—56, 58—58 unattached to the surfaces of the intermediate board.

The structure is designed to be easily manufactured with conventional die cutting and glueing machinery so that it is inexpensive to manufacture, easy to fold for storage purposes, easy to set up for use without special manipulation and is sturdy.

It should be understood that the present disclosure is for the purpose of illustrtion only and includes all modifications or improvements which fall within the scope of the appended claims.

I claim:

1. An easel comprising, a panel containing between its front and back surfaces a pocket, and in the back surface an opening into the pocket symmetrically disposed with respect to the pocket so that portions of the pocket extend laterally from the opposite edges of the opening, a leg member hinged at its upper end within the pocket on a hinge coinciding with the top of the opening for angular movement rearwardly from the opening and means for supporting the leg in an angular rearwardly disposed positions relative to the panel to hold the latter upright, characterized in that said means embodies articulated members slidingly engaged within the pocket at each side of the opening, said articulated members comprising proximal sections hinged at one edge to the leg adapted to be slid outwardly of the pocket and into the pocket solely by pushing and pulling the leg rearwardly and forwardly relative to the panel and distal sections hinged at one end to the outer edges of the proximal sections which remain in the pockets when the leg is pulled outwardly and which limits outward movement of the proximal sections, said distal sections being frictionally engaged within the pockets so as to retain the leg in either position.

2. An easel according to claim 1, wherein the panel comprises a face board and a back board attached back to front with the pocket between the boards and wherein the opening is in the back board and is symmetrically located with respect to the ends of the back board and wherein the leg corresponds substantially in length to the distance between the top and bottom edges of the opening.

3. An easel according to claim 1, wherein the proximal sections constitutes braces movable rearwardly with the leg and wherein there are notches at opposite sides of the opening at the bottom within which the lower edges of the braces are engaged when the leg is drawn rearwardly on the one hand to hold the lower edges of the braces at a predetermined spacing and on the other hand to guide the braces into the pocket when the leg is folded.

4. An easel according to claim 2, wherein the top of the opening is spaced from and parallel to the top of the panel and the bottom coincides with the bottom edge of the panel structure.

5. An easel according to claim 2, wherein the leg is hinged to an intermediate board situated between the face board and backboard.

6. An easel according to claim 5, wherein the leg, an articulated member are formed out of the intermediate board and are integral.

7. An easel according to claim 2, wherein the face board and backboard are coextensive.

8. An easel according to claim 2, wherein there is an intermediate board coextensive with the face board and backboards, sandwiched therebetween and the leg, an articulated member are cut out of the intermediate board.

9. An easel according to claim 8, wherein the backboard is hinged at its lower longitudinal edge to the lower longitudinal edge of the face board and at its upper longitudinal edge to the upper longitudinal edge of the intermediate board, wherein the intermediate board is sandwiched between the face board and backboard with portions of the several boards attached and other portions unattached to provide for said pocket between the boards and wherein the leg, and articulated members are formed in the intermediate board within the unattached portion.

10. An easel according to claim 2, wherein the opening in the backboard has a straight top edge spaced from and parallel to the top edge of the backboard, spaced parallel, straight side edges perpendicular to the top edge, said side edges comprising straight edge portions extending from the top edge part way to the bottom of the opening and re-entrant edge portions extending the remainder of the way to the bottom of the opening, said straight edge portions confining the distal sections within the pocket and said re-entrant edge portions providing clearance spaces for movement of the proximal sections into and out of the pocket.

11. An easel according to claim 10, wherein the re-entrant edges contain notches for receiving the lower edges of the proximal sections.

12. An easel according to claim 8, the leg tapers from its upper hinged end to its lower end having converging longitudinal edges, the proximal sections are triangular having opposite sides of substantially equal length and are connected at one edge to the longitudinal edges of the leg and the distal sections are triangular having two right sides and a hypotenuse connected along the hypotenuse sides to the other edges of the proximal sections with their base side parallel to the hinge at the upper end of the leg and the altitude side perpendicular to said hinge.

* * * * *